United States Patent [19]

Hosoya et al.

[11] Patent Number: 5,051,332

[45] Date of Patent: Sep. 24, 1991

[54] ELECTROPHOTOGRAPHIC IMAGE FORMING METHOD USING ONE COMPONENT TONER AND SIMULTANEOUS CLEANING AND DEVELOPING

[75] Inventors: Masahiro Hosoya, Okegawa; Mitsunaga Saito, Tokyo; Yoshimitsu Ohtaka, Mishima; Mitsuharu Endo, Susono; Yukio Futamata, Shizuoka, all of Japan

[73] Assignees: Kabushiki Kaisha Toshiba, Kanagawa; Tokyo Electric Co., Ltd., Tokyo, both of Japan

[21] Appl. No.: 489,818

[22] Filed: Mar. 9, 1990

[30] Foreign Application Priority Data

Mar. 10, 1989 [JP] Japan ..... 1-59411
Sep. 28, 1989 [JP] Japan ..... 1-253070

[51] Int. Cl.[5] ..... G03G 13/24; G03G 13/09

[52] U.S. Cl. ..... 430/122; 430/125; 430/903; 118/652; 355/296

[58] Field of Search ..... 430/125, 102, 103, 122; 355/296; 118/652

[56] References Cited

U.S. PATENT DOCUMENTS 4,637,973 1/1987 Shigeta et al. ..... 430/110

*Primary Examiner*—David Welsh

*Attorney, Agent, or Firm*—Finnegan, Henderson, Farabow, Garrett and Dunner

[57] ABSTRACT

An image forming method which includes the steps of providing a developing agent holder for holding one component developing agent layer arranged to contact a latent image holder, developing a latent image on the latent image holder and to simultaneously clean up the developing agent adhering to the surface a non-latent image area on the latent image holder, wherein the cleaning up is carried out under the condition expressed by the following formula:

$$0.5 \leqq (Vd/Vp) \cdot m \leqq 3.0$$

wherein ghe moving speed of the developing agent holder is defined as Vd, the moving speed of the surface of the latent image holder is defined as Vp and the developing agent adhering density is defined as m ($mg/cm^2$), and the amount of the remaining toner after transferring that remains on the latent image phase of the latent image holder is set less than 0.35 $mg/cm^2$. Further, an image forming device is provided with a blade arranged to be pressed against the latent image holder in order to uniformly distribute the toner remaining on the latent image phase of the latent image holder. Therefore, a satisfactory image having excellent quality without ghost images and fogging can be always obtained, and the satisfactory image can be obtained in a high humidity environment.

10 Claims, 5 Drawing Sheets

ELECTROPHOTOGRAPHIC IMAGE FORMING METHOD USING ONE COMPONENT TONER AND SIMULTANEOUS CLEANING AND DEVELOPING

BACKGROUND OF THE INVENTION

1. Field of the Invention

The present invention relates to an image forming method depending on the electrophotographic process or the electrostatic recording process, and more particularly relates to a cleanerless image forming method which is capable of forming an image without the use of a cleaning device for cleaning excess toner remaining on the photosensitive drum after transferring the image.

2. Description of the Related Art

In general, an image forming method as shown cross sectionally in FIG. 1 is used, for example, in the device for imaging a latent image (image), such as the electrophotographic apparatus or the electrostatic recording apparatus. Usually, the apparatus is provided with a latent image holder, for example, a sensitive drum 1, an electrification device 2 arranged on the periphery of the sensitive drum 1, an exposure device 3, a developing device 4, a transfer device 5 and a cleaning device 6 having a cleaning blade 6*a* is used. Therefore, an electrostatic charge is applied by the electrification device 2 on the surface of the sensitive drum 1, and the selective exposure is carried out by the exposure device 3 in the electrification area to form a latent image in the apparatus mentioned above. And, the toner is selectively adhered to the formed latent image area (after the toner image is formed) by the developing device 4, then, the obtained toner image is transferred on a transfer paper 7 in the transfer device 5. The remaining toner adhering to the surface of the sensitive drum 1 is removed by the cleaning blade 6*a* of the cleaning device 6.

However, in the apparatus described above, the cleaning device 6 is required to be separately provided to the position opposing to the developing device 4. Therefore, a limitation is placed on the arrangement of the electrification device 2, the exposure device 3, the transfer device 5 and other devices required for forming certain images. Further, the flexibility in the design of the devices is decreased. And, a surface of the sensitive drum 1 is worn by the cleaning blade 6*a*, which causes disadvantages, such as the deterioration of the characteristics and the decrease of the service life, during the cleaning operation. Further, an ozone product is generated during electric charging in the electrification device 2, thereby, a negative electrode organic photo conductor (referred to as "OPC", hereinafter) is deteriorated. Therefore, the surplus ozone products are required to be exhausted immediately. However, this causes a problem in that an exhaust path for the ozone products is inhibited by the cleaning device 6. Further, the toner retrieved in the cleaning device 6 is required to be suitably discarded. Therefore, problems are created in that the maintenance becomes complicated and the peripheral devices are possibly tarnished and stained.

In view of the problems mentioned above, a device having an exclusive cleaning device for carrying out developing during the first rotation of the sensitive drum 1 by means of the developing device and for cleaning during the second rotation by means of the same developing device 4, has been proposed, as described in Japanese Patent Application Laid-Opened Official Gazette SHO-62-211681. However, in the case mentioned above, since the developing step and the cleaning step are carried out separately, it is necessary that the sensitive drum 1 has a longer periphery than the image length to be formed. Therefore, not only must the sensitive drum have a large size, but also the whole device.

The image forming device (referred to as "cleanerless image forming device" hereinafter) for retrieving the remaining toner simultaneously with developing an image by means of the developing device without using the cleaning device has been known and is described, for example, in Japanese Patent Application Laid-Open No. 133573, 1984 and Japanese Patent Application Laid-Open No. 157661, 1984. In the official gazettes as described above, the basic conception of the cleanerless image forming device is disclosed, and the essence thereof can be summarized as described below. The main construction of the well-known reversal developing method is shown cross sectionally in FIG. 2. This reversal developing method is used in many cases in electrophotographic printers, such as a laser printer. In the reversal developing method, the toner particles 8 charged to have similar polarity as a latent image holder, for example, the sensitive drum 1, are adhered to a portion of the surface of the sensitive drum where an electric does not exist (or exists in a small amount). Herein, the toner particles 8 are not adhered to the portion where the electric charge exists. For achieving such selective adhesion of the toner, the voltage $V_b(|V_1|<|V_b|<|V_0|)$ between the electric potential $V_0$ of the charged portion and the electric potential $V_1$ of non-charged portion on the surface of the sensitive drum 1 is applied to a toner holder 4*a* (developing agent holder) in the developing device 4. And the adhesion to the sensitive drum 1 is controlled by the electric field between the charged portion. Then, the toner 8 is adhered to the sensitive drum 1 by the electric field between the non-charged portion. The toner 8 adhered to the sensitive drum 1 is transferred to an image supporter 7 by means of the well-known transfer device 5. During the transfer step, not all of the toner is transferred, and the remained toner 8' remaining after transfer is present on the surface of the sensitive drum 1 in the image form. In the usual image forming device, for example, the electrophotographic device, the remaining toner 8' is retrieved by means of the cleaning device 6 shown by the dashed lines. Then, the electric charge on the surface of the sensitive drum 1 is removed by means of an electric removal lamp 9, and it is returned to the latent image forming step (a uniform charging device 2 step by the charging and an exposure step by the exposure device 3). In the cleanerless image forming device, the remaining toner 8' is transferred to the developing step without using the cleaner device 6 and is retrieved in the developing device 4 simultaneously with developing.

Since the remaining toner 8' existing in the charged portion (non-exposed part or non-imaged part) in the latent image formed by the exposure of the exposure device 3 is certainly charged to have the same polarity as the latent image by means of the electrification device 2, it is transferred to the toner holder 4*a* side by means of the electric field (electric field caused by the potential difference between $V_0$ and $V_b$) for controlling the transfer of the toner 8 from the toner holder 4*a* to the sensitive drum 1. Simultaneously, the remaining toner 8, existing in the non-charged portion (namely, the exposure part or the image part) is affected by the force from the toner holder 4*a* to the sensitive drum 1 to remain on the surface of the sensitive drum 1. The newly supplied toner particles 8 are transferred from the toner holder 4*a* to the non-charged portion, thereby, the cleaning is carried out simultaneously with the developing.

As described above, since the cleaning device 6 and the waste toner box are not required in the cleanerless recording device, the miniaturization and the simplification of the device can be facilitated. Therefore, the merits as described below can be obtained. Since the remaining toner 8, retrieved in the developing device 4 can be reused, it becomes economical because toner is not wasted. Since the sensitive drum 1 is not worn by the cleaning blade 6*a*, it has a longer service life of.

However, in the cleanerless image forming device, a ghost image is possibly caused by the following reasons.

First, in a high humidity environment, since the paper as the image supporter 7 takes the moisture to be low resistance, the transfer efficiency becomes lower. Therefore, a lot of toner particles tend to remain on the surface of the sensitive drum 1. When the amount of the remaining toner 8′ becomes excessive, it cannot be completely cleaned up in the developing device 4. Therefore, the remaining toner 8′ stays on the non-imaged part to cause a positive ghost on a white portion of the transfer image (referred to as "positive ghost" image or "positive memory" hereinafter).

Second, when the amount of the remaining toner 8′ becomes excessive, the light beam 3 is intercepted by the remaining toner 8′ during the exposure step by the exposure device thereby, the damping of the electric potential on the surface of the sensitive drum 1 results in an insufficient the electric potential (referred to as "$V_1$′") in the intermediate between $V_0$ and $V_1$. In the portion as described above, the developing voltage becomes as $V_b-V_1'$, which is smaller than the developing voltage $V_b-V_1$ of the periphery exposure part. Therefore, the toner transfer amount from the toner holder 4*a* to the Sensitive drum 1 becomes smaller as compared with the periphery, thereby, the remaining toner image appears on the developing part of the transfer image as a void image (referred to as "negative ghost" image or "negative memory", hereinafter). This phenomenon notably appears especially in the half-tone image formed of the aggregation of the net point image and the line image, etc.

Japanese Patent Application Laid-Open No. 203183, 1987, discloses to removing the ghost image by applying a voltage to an electroconductive brush 10 having such formation as shown cross sectionally in FIG. 3 to be contacted slightly with the sensitive drum 1. Namely, the voltage having the reverse polarity to the electro static charge of the toner is applied to the electroconductive brush 10 by the direct current power, and the remaining toner 8′ is absorbed at once by the brush 10 by the Coulomb force. Therefore, the amount of the remaining toner 8′ on the surface of the sensitive drum 1 can be remarkably decreased, and the above mentioned ghost image can be avoided.

However, in the case of the above system, under the experiment by the present inventor, the deterioration of the cleaning characteristics is often found according to the amount of one component developing agent layer formed on the developing agent holder 4*a* and other developing conditions when the development cleaning is carried out on using one component developing agent. Further, it becomes clear that the sufficient condition carrying out only the developing cannot be always applied thereto. Namely, the paper as the image holder 7 holds (absorbs) much moisture under high humidity conditions, therefore, the resistance ratio is remarkably decreased. As a result, the electric charge provided from the transfer device 5 to the paper 7 moves to the thickness direction of the paper 7 to reach the toner particles on the surface of the sensitive drum 1, thereby, the toner is charged in the reverse polarity to the essential electro static charge. Since the toner charged in the reverse polarity is affected by the repulsive force caused by the electric field even if contacting with the electroconductive brush 10, it is not absorbed by the electroconductive brush 10. Further, the dispersion of the remaining toner image 8′ can be kept substantially in it's original condition after passing through the brush. Therefore, the above mentioned ghost image cannot be avoided in such case.

Further, since the amount of the toner which can be held in the electroconductive brush 10 has limitations, the toner is naturally expelled to the surface of the sensitive drum 1 when it builds up to a specific level. The expelled toner is not dispersed in an image form like the remaining toner 8′ and it shows the remarkably uniform dispersion, therefore, the above mentioned ghost image is not induced. However, in the case in which the solid image is sequentially output (sequential development of the solid image), a lot of the toner is held in the electroconductive brush 10 to cause the possible expulsion of the toner to the surface of the sensitive drum 1. In such case, the above mentioned ghost image is generated.

Because of the problems as mentioned above, the image forming by the conventional cleanerless image forming method is hard to carry out in a high humidity environment. Further, it has been caused a disadvantage that the property of the image capable of being output has the limitation.

Therefore, the first object of the present invention is to provide an image forming method which is capable of obtaining always producing a satisfactory image without ghost images and fogging by carrying out certain developing using one component toner (developing agent) and simultaneously cleaning up efficiently the remaining and adhered toner on the surface of the sensitive drum.

Further, another object of the present invention is to provide a cleanerless image forming device which is capable of producing a satisfactory image in a high humidity environment and capable of outputting any kind of image.

SUMMARY OF THE INVENTION

An image forming method of the present invention is carried out by providing a developing agent holder for holding a one component developing agent layer arranged to contact with a latent image holder, and developing a latent image (imaging part) on the latent image holder and simultaneously cleaning up the developing agent adhering to the surface of a non-latent image area (non-imaging part) on the latent image holder, wherein the cleaning up is carried out under the condition expressed by the following formula:

$$0.5 \cong (Vd/Vp) \cdot m \cong 3.0$$

wherein the linear velocity of the developing agent holder is defined as Vd, the moving speed of the surface of the latent image holder is defined as Vp and the developing agent adhering density is defined as m ($mg/cm^2$), or the amount of the remaining toner after transferring that remains on the latent image phase of the latent image holder is set less than 0.35 $mg/cm^2$. Further, an image forming device of the present invention is provided with a remaining toner distributing means for uniformly distributing the toner remaining on the latent image phase of the latent image holder which is arranged to be pressed in contact with the latent image holder such that the above mentioned image forming method may be applied. Using the present invention, a satisfactory image having an excellent quality without ghost images and fogging can always be produced, and a satisfactory image can be obtained in a high humidity environment condition.

DETAILED DESCRIPTION OF THE PREFERRED EMBODIMENTS

EXAMPLE 1

Figure 1:
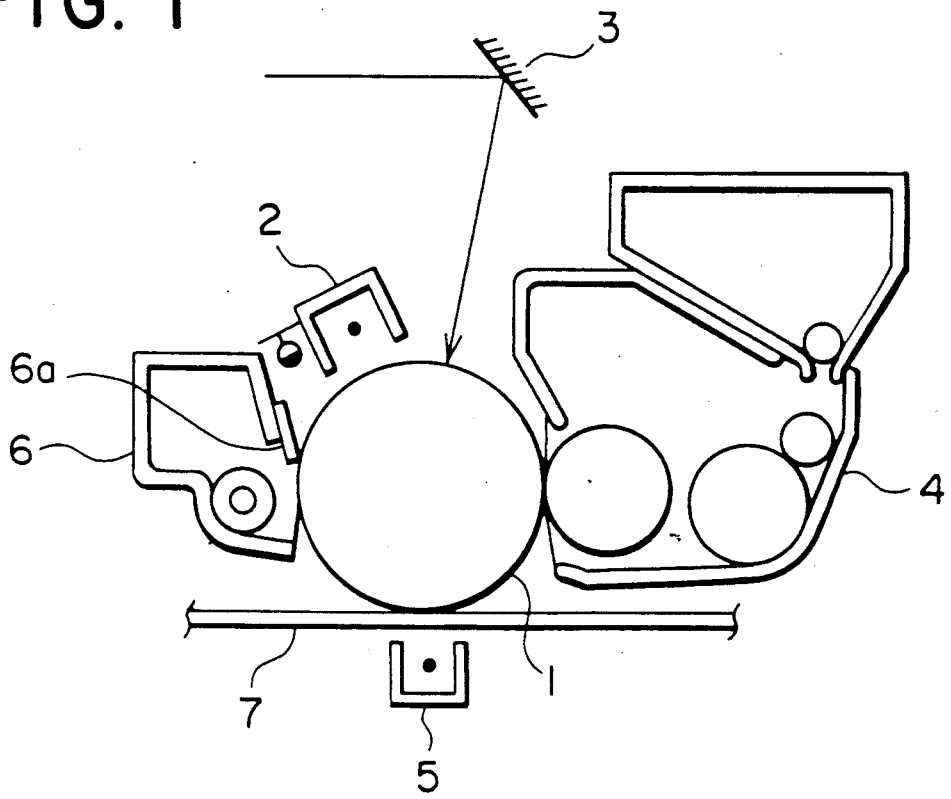
FIG. 1 is a cross-sectional view showing the main portion of an image forming device provided with a cleaning device.
Figure 2:
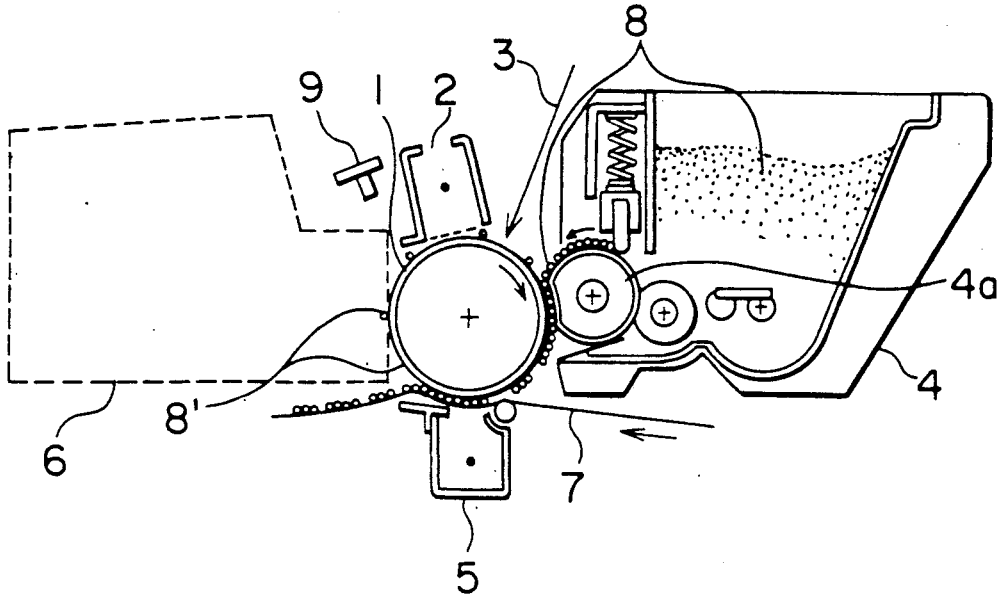
FIG. 2 is a cross-sectional view showing the main portion of a cleanerless image forming device.
Figure 3:
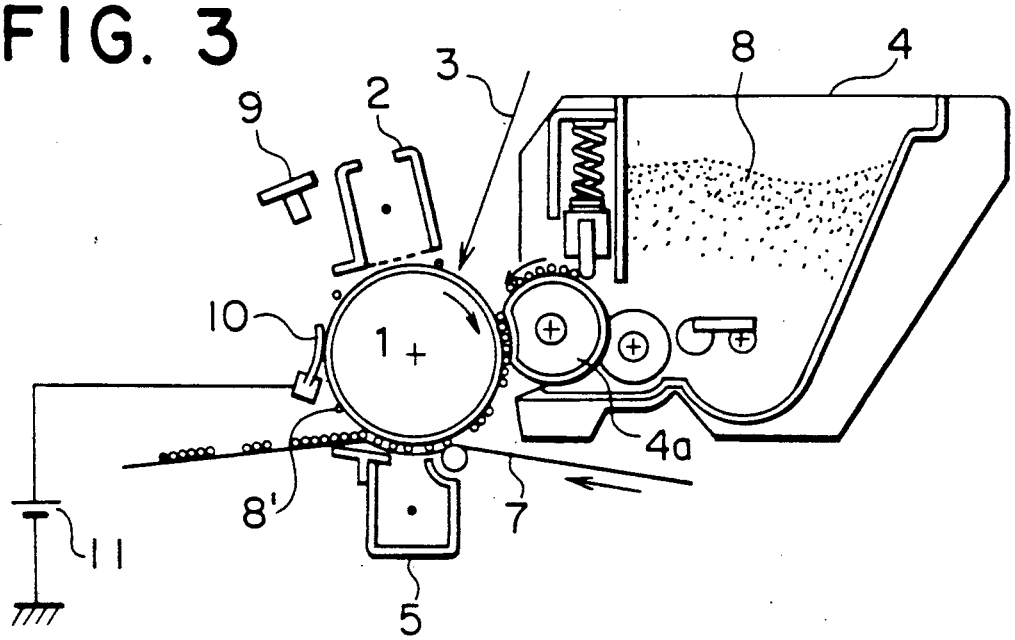
FIG. 3 is a cross-sectional view showing the main portion of another cleanerless image forming device.

First, a function on forming a latent image on a latent image holder and cleaning up simultaneously the toner remaining adhered to the latent image holder will be explained.

A developing roller is provided for holding a toner particle layer which is charged to have similar polarity to a latent image electric charge. The developing roller is arranged to oppose to a sensitive drum which acts as a latent image holder. By applying a predetermined bias voltage to the developing roller, the development is carried out by an electric field formed in a low electric potential portion (exposure portion), and simultaneously the toner which remains adhered to the surface of the sensitive drum is removed (cleaned up) by the electric field in a high electric potential portion (non-exposure portion). Herein, it is important that the above-mentioned electric fields are formed between the developing roller and the latent image so that the remaining toner on the surface of the sensitive may be removed. Namely, when the adhered toner layer on the surface of the developing roller is formed thickly, the electric field inhibiting the absorption of the remaining toner is formed by the toner layer, therefore, the repulsive force affects the remaining toner charged in similar polarity thereto. When the adhering amount of the toner adhering to the surface of the developing roller is large, the cleaning of the remaining toner is not carried out. Therefore, a ghost image or fogging is caused by the remaining toner in the developed image. However, when the adhering amount of the toner adhering to the surface of the developing roller is small, the cleaning is effectively carried out, but sufficient image density cannot be obtained because the amount of the toner adhering to the latent image part (image part) is small. Therefore, the problem of determining the amount of the adhering toner on the surface of the developing roller that should be applied can be essentially solved by manipulating the moving speed ratio Vd/Vp of the developing roller and the sensitive drum. Namely, the amount of the toner supplied to 1 $cm^2$ on the surface of the sensitive drum in one second can be expressed as Vd/Vp·m ($mg/cm^2$) when the toner adhesion amount (adhesion density) on the developing roller is defined as m ($mg/cm^2$). Therefore, the thickness of the toner layer existing at the developing position can be considered as (Vd/Vp) times of the toner layer apparently formed to adhere to the surface of the developing roller. The thickness of the toner layer (effective toner adhesion amount) is required to be set in a certain range for a really effective cleaning mechanism.

In the present invention, the effective toner layer thickness and/or the effective toner adhesion amount (Vd/Vp)·m is set at not less than 0.5 ($mg/cm^2$) and not more than 3.0 ($mg/cm^2$) to form a certain cleaning electric field between the high electric potential part (non-exposure part) and the developing roller, and the cleaning is efficiently carried out and the sufficient amount of the toner adhesion can be obtained simultaneously in the low electric potential part (exposure part) of the latent image. Thereby, a sufficiently developed image having high density can be easily obtained without ghost images and fogging.

Figure 4:
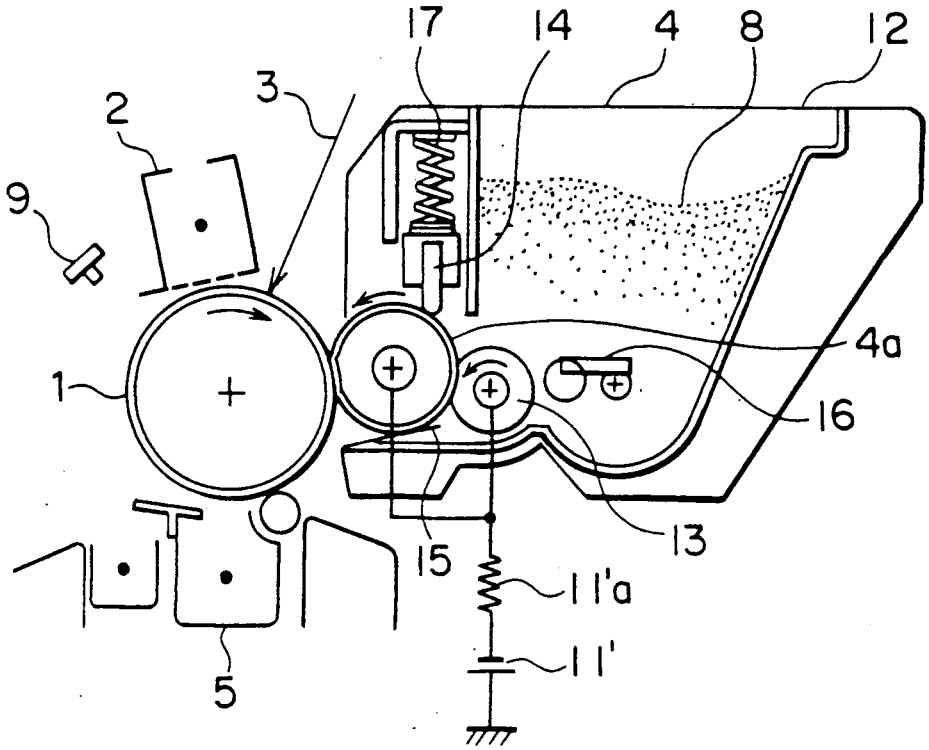
FIG. 4 is a cross-sectional view showing the main portion of a cleanerless image forming device used in an image forming method according to the present invention.
Figure 5:
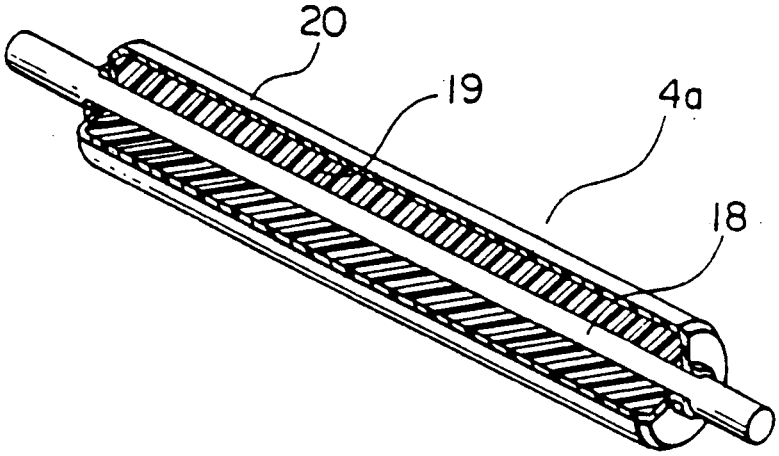
FIG. 5 is a partially cut perspective view showing a construction of a developing agent holder (developing roller) provided in a cleanerless image forming device used in the image forming method according to the present invention.

Next, an example of the present invention will be explained with reference to FIGS. 4 and 5. FIG. 4 is a view showing cross-sectionally the main portion construction of the image forming device used in the method according to the present invention. A developing device 4 is provided with a toner container 12 for storing one component toner 8' a toner supply roller 13 for supplying the one component toner 8 to a developing roller (developing agent holder) 4*a*, a coating blade 14 for forming a substantially uniform toner layer by controlling the amount of toner supplied to the developing roller 4*a*, a sensitive drum 1 contacting with the developing roller 4*a* for holding a latent image held on its surface, a recovery blade 15 for recovering remaining toner 8' in the toner container 12, an agitator 16 for agitating the toner 8 stored in the toner container 12, and a spring 17 for pressing the coating blade 14 against the developing roller 4*a* with a constant load.

The sensitive drum 1 can be form, for example, of selenium, cadmium sulfide, zinc oxide, amorphous silicon and organic type, and the organic sensitive body is used in the present example. The sensitive drum 1 of the present example is uniformly negatively charged by means of a scolotron charging device 2, and exposed by means of a light beam, for example, a laser beam 3 from a exposure device which is image modulated, thereby, a certain electrostatic latent image is formed on the surface of the sensitive drum 1. The electrostatic latent image is visualized by means of the developing roller 4*a* as mentioned above, thereby, the toner image is formed. Then, the toner image formed as mentioned above is transferred to a transfer paper, by means of a transfer charger (transfer device) 5 and is fixed by means of a fixing device. Here, the toner 8 is only partially transferred, and thus toner remains on the surface of the sensitive drum 1 (referred to as "remaining toner 8'", hereinafter). This remaining toner 8' is usually removed by means of a cleaning blade. However, in the present invention, the developing device 4 serves the function of the cleaner. Namely, the remaining toner 8' on the sensitive drum 1 is recharged by the charging device 2 after it is aimed by means of an electric removal lamp 9. At this moment, the remaining toner 8' is also charged to have similar polarity with the surface of the sensitive drum 1, and the forming of the electrostatic latent image by exposure and the visualization of the image are repeated. During these steps, the remaining toner can be retrieved in the developing device 4 in the manner as mentioned below. Namely, the electric potential of the non-exposure part is defined as Vo and the electric potential of exposure part is defined as Vq among the electric potential on the surface of the sensitive drum, and the developing bias voltage Vb applied on the developing roller 4*a* through a protection resistance 11'*a* is defined by means of a direction current electric power 11'. Further, the electric potential on the surface of the developing roller 4*a* (effective developing bias) Ve is set to be similar to the developing bias voltage Vb, thereby, the electrostatic latent image is reversibly developed by the one component toner charged in the negative polarity. In the reversal developing, the effective developing bias Ve is set to satisfy the condition $|Vo|>|Ve|>|Vq|$ (wherein each Vo, Ve, Vq is negative), the development is carried out by the electric potential difference $Ve-Vq$, and the control of the toner adhesion to the non-image part (control of fogging) is carried out by the electric potential difference $Vo-Ve$ In the present example, negatively charged remaining toner 8' is adhered to the surface of the sensitive drum 1, and the remaining toner 8' existing on the non-exposure part (non-image part) is affected by the attractive force caused by the electric potential difference $|Vo-Ve|$ at the development position and is transferred to the surface of the developing roller 4*a*arranged at higher electric potential side (positive electric potential side). In the exposure part (image part), the development is carried out by the action of the electric potential $|Ve-Vq|$ as the remaining toner 8' is being adhered, then, the toner is transferred from the surface of the developing roller 4*a* to the surface of the sensitive drum 1. When the development of the exposure part is carried out, the remaining toner 8' on the non-exposure part is retrieved in the developing device 4 at the same time.

An explanation of the construction and/or the component member of the developing device 4, and how the developing roller 4*a* is constructed is described below. Namely, as shown perspectively as the partial cut portion in FIG. 5, a flexible layer 19 and the surface conductive layer 20 are coaxially arranged in order to receive electroconductive shaft 18 as its center shaft, and the surface conductive layer 20 is arranged to extend in the end phase side of the developing roller 4*a* to communicate with the electroconductive shaft 18. The surface of the developing roller 4*a* and the electroconductive shaft 18 are electrically conductive. Therefore, the developing roller 4*a* is structured to have an electric resistance between the surface thereof in 1 $cm^2$ and the electroconductive shaft 18 being set at not more than $1\times10^9\Omega\cdot cm^2$, preferably not more than $1\times10^7\Omega\cdot cm^2$.

The definition of the resistance R of the developing roller in the present invention is as follows. Generally, specific resistance $\rho$ is used as a resistance value of a substance. The product $\rho\cdot le$ (=R) of the specific resistance value $\rho$ and by the thickness of the flexible layer le is used as a roller parameter on which the developing characteristics practically depend. However, practically, an electrode having an area S is contacted on the surface of the developing roller, and an ammeter is connected to the electrode. The resistance value $R_O$ (=10/I) is calculated from the electric current value (I) measured after applying a voltage of 10 V to the shaft. Furthermore, the resistance value R is obtained from $R=R_0\cdot S$. $R_0\cdot S=\rho\cdot le$ is established, using the general formula for the definition of the resistance value, $R_0=\rho.le/S$. Thus, the roller resistance value R ($=\rho\cdot le$) of the present invention can be calculated to be equal to $R_0\cdot S$.

Further, in the developing roller 4*a*, the surface conductive layer 20 is required to be conductive, wear resistant, chemically stable and adhesively securable to the flexible layer 19. Therefore, the surface conductive layer 20 is formed by coating a compound prepared from an elastomer or a resin, such as polyurethane, polyester, tetrafluoroethylene, polystyrene, acrylic and silicone with electrically conductive carbon, metal powder or metallic fiber contained to be dispensed to have a specific resistance of not more than $10^8\Omega\cdot cm$, preferably not more than $10^6Q\cdot cm$ by spraying or dipping the surface of the flexible layer 19, or by covering an electroconductive tube formed of the above mentioned prepared compound with the surface of the flexible layer 19. The chamfering of about C 0.2 through C 3 or the R working of about R 0.2 through R 3 is preferably carried out previously on both end portions of the conductive layer 19. If the working is done to obtain such form, the possible wearing and peeling of the conductive layer 20 formed on the surface of the flexible layer 19 for the end portion or the end phase of the developing roller 4*a* can be avoided. Therefore, the conductivity of the electroconductive shaft 18 can be kept for a long period of time. For example, even under the printing test for printing one hundred thousand (100,000) sheets having A4 size, satisfactory development was obtained.

Next, an example in which an electrically conductive urethane elastomer is coated on the developing roller 4*a* will be explained.

Example 1 of developing agent holder roller

A coating material combined with an urethane type electroconductive elastomer coating "ELECTRO PACK Z-279" (the trade name, manufactured by Taiko Kako Co., Ltd.), a non-yellowing isocyanate type curing agent and a thinner as a diluent being combined in the rate of 10:1:2 was prepared. And the prepared electroconductive coating material was coated on the flexible layer and the end phase on preparing a roller base formed to be coated coaxially with the flexible layer on taking the electroconductive shaft as the center axis, setting a direction of a spray gun (the center line of jet direction of the mist jetted from the gun) to the center axis of the roller base in 10° through 80°, and moving the spray in the axis direction of the roller base. In the coating of the electroconductive coating material, a uniform coating can be easily formed on both end phases of the roller by setting to the center axis of the roller in 100° through 170° and using jointly therewith. Therefore, a satisfactory electroconductive coating can be formed more efficiently to the periphery of the shaft roller. Then, a developing roller provided with an electroconductive layer having a thickness of 100 μm was constructed by drying on leaving at a normal temperature or at 50° through 60° C. for 5 through 6 minutes. Then, the resistance value was obtained by contacting an electrode having an area of 1 $cm^2$ with the periphery of the developing roller and applying a voltage having 10 V to the electrode and connecting the shaft with an ammeter to measure an electric current, and the obtained values were $10^3$ to $10^7$ $\Omega \cdot cm^2$.

Example 1 of developing agent holder roller

For forming the developing roller, the similar electroconductive coating material as described above was used except an acrylic urethane type electroconductive coating material was used. And the obtained resistance value were $10^4$ to $10^{10}$ $\Omega \cdot cm^2$.through The developing roller structured as described above was mounted on the image forming device shown in FIG. 4, and the cleaning characteristics were checked upon forming an image.

First, the resistance value of the developing roller 4a was determined. Satisfactory development cleaning can be obtained when the resistance value is not more than $1 \times 10^9 \Omega \cdot cm^2$, preferably not more than $1 \times 10^7 \Omega cm^2$. Namely, if the resistance value exceeds $1 \times 10^9 \Omega \cdot cm^2$ during the development, fogging results and the image density will be decreased when varying the electric potential on the surface of the developing roller 4a (effective developing bias) by the electric current flowing between the developing roller 4a and the electric power for the development bias 11'. Further, with the resistance in the range of $1 \times 10^9$ to $1 \times 10^7 \Omega \cdot cm^2$, the problems of fogging or decreased image density will tend to be slightly effected depending on the charge of the toner which is used.

Next, the experiment was carried out by changing the thickness of electroconductive layer 20 through the range of 5 to 500 μm for the above mentioned developing agent hold roller (developing roller) 4a. It was confirmed that the thickness should preferably be set preferably in the range of 20 to 400 μm. Namely, the possibility of damaging the function of the electroconductive layer 20 and causing fogging or the density unevenness can surely be reduced.

Further, a sample was formed in view of the smoothness and/or the roughness of the electroconductive layer 20 for the developing agent hold roller (developing roller) 4a, and the characteristics estimation was carried out. As a result, it becomes clear that the ratio not more than 3 μmRz is preferable on the basis of 10 point average roughness defined in the JIS (Japanese Industrial Standard) 0601. Namely, if the ratio exceeds 3 μmRz, the thickness of the adhered toner layer increases, the amount of non-charged toner increases, the fogging and the cleaning failure will be caused as a result. It is desirable that the ratio is not more than 10 μm Rmax when it is defined by the maximum height (Rmax) of the above mentioned JIS-0601.

The characteristics required for the flexible layer 19 of the developing roller 4a are, for example, the hardness, the compression permanent strain, the chemical stability, and the capability to adhere to the electroconductive layer 20. Namely, the hardness is desired to be soft in view of the object of increasing the working accuracy of the device and the parts, and for softening the requirement for the assembling accuracy. The hardness should be about 10 to 40 degrees, preferably about 20 to 30 degrees on the basis of the A-type rubber hardness meter in the JIS-6301. Further, the compression permanent strain is desired to be not more than 20%, preferably not more than 10% on the basis of the measuring method in the JIS-6301, namely, the method for measuring the strain amount to define with the percentage (%) on compressing the 25% of thickness of the specimen, leaving for 22 hours at a temperature of 70° C. Here, since the material provided with a flexible layer having thickness of 5 mm arranged on the outer periphery of the shaft having an outer diameter of 8 mm to have the final outer diameter of 18 mm was used as a specimen, the compression of 25% is corresponding to the compression of $5 \times 2 \times 0.25 = 2.5$ mm, and if the compression permanent strain exceeds 20%, the strain will be possibly caused at the compression position of the coating blade to appear as a white line on the image. Further, in view of the chemical stability, this is the most important characteristics for the actual application.

For example, allowing the dispersedly contained additives to be deposited to react with the toner should be avoided, and allowing the toner to or to react with the sensitive layer to cause the deterioration of the sensitivity should be avoided. Further, the adhesive property with the surface electroconductive layer is also important. The following materials satisfy such points mentioned above; NBR rubber, chloroprene rubber, urethane rubber, silicone rubber, ethylene propylene rubber (EPR or EPDM), urethane type foaming material, and silicone type foaming material, etc. When the silicone rubber is used, a primer treatment is required for obtaining sufficient adhesiveness with the surface electroconductive layer. Further, a plasticizer or a curing agent is not preferably contained when the flexible materials described above are used.

For the toner supply roller 13, an urethane foam having cell constant of 100/25 mm is preferred. The material made by mixing the above-mentioned urethane foam with an electrically conductive carbon powder to add the electroconductivity acts to loosen a electrostatic cohesion of the toner, therefore, it is suitable for forming the uniform toner layer. Further, a brush roller or a low hardness rubber roller having a hardness not more than 10 degrees is also applicable. The toner supply roller 13 is provided with the contact depth of about 0.1 through 1.0 mm to the developing roller 4a, and is rotated at the linear velocity of about ¼ to 2 times that of the developing roller 4a. Namely, the toner can be supplied even in the case of whole phase black solid development wherein a large amount of the toner is required.

The coating blade 14 controls the amount of the toner adhering to the surface of the developing roller 4a and acts to add a tribo electric charge by means of frictional electrification, therefore, it is formed of a material which is easily frictionally charged. Namely, since toner particles are to be negatively charged in this example, it is preferable to select material positioned at the positive side in the frictional electrification order, for example, silicone rubber, polyamide resin, melamine formalin resin, polyurethane rubber, styrene acrylonitrile copolymer, sheep wool, on quartz, etc. For the actual application, it is necessary to select a material which will help prevent the formation of a nonuniform toner layer on the surface of the developing roller 4a when the toner 8 is adhered to the coating blade 14 even when it is used for a long period of time. As a result of the experiment carried out by the present inventor, when the silicone rubber having a mold release property was used, the adhesion of the toner was not caused after the printing experiment used therein one hundred thousand of sheets of A4 size paper, and the toner layer had a uniform thickness that was maintained. Further, the toner particles were negatively charged, and the adhesion of the toner charged in the reverse polarity was not found in the background part of the obtained image. Furthermore, since the toner layer was thin, a decrease and/or a degradation of the cleaning characteristics was not confirmed.

The process for the formation and the contacting system for the coating blade can be, for example, a process for pressurizing the belly portion of the slab, a process for pressurizing the edge portion of the slab and a process for pressurizing the plane of end portion of the slab. In view of the point in which the uniform toner layer can be formed constantly by a slight pressure force (control of the adhesion amount), the process for pressurizing the edge portion of the slab is effective. However, if the sharp edge is used as it is, it will cause disadvantages in that the uniformity of the toner is remarkably effected by the quality of the working accuracy of the edge and the mount accuracy of the coating blade 14, and the toner particles passing under the pressure force cannot be sufficiently frictionally charged because of the small contacting area. In view of the point as described above, it is preferable that the edge is worked in circular. Namely, the thin layer can be formed by the light load and the toner can be surely charged by the circular edge. For example, a coating blade 14 made of silicone rubber having the thickness of 3 mm and the top end portion worked in circular shape to have a diameter of 3 mm was used for the development to control the toner layer held on the surface of the developing roller 4a in the system in which the circular portion is pressed to contact or the belly portion is pressed to contact. The obtained results are shown in the following table.

In the table, the estimation subject A designates an appropriate load (whole load÷length of blade), B designates a rotation torque of the developing roller, C designates the amount of toner adhesion (weight of toner adhered to unit area of developing roller surface), D designates the charged amount of the toner; E designates the image density, F designates the fogging (visual estimation for image), and G designates the cleaning characteristics (visual estimation for image).

TABLE

| SUBJECT | PRESS CONTACT OF CIRCULAR PORTION | PRESS CONTACT OF BELLY PORTION |
|---|---|---|
| A | 10 to 50 g/cm | 70 to 150 g/cm |
| B | 800 to 1000 g · cm | 1500 to 2500 g · cm |
| C | 0.4 to 0.8 mg/cm$^2$ | 0.9 to 1.5 mg/cm$^2$ |
| D | −6 to −20 μc/g | −2 to −10 μc/g |
| E | 1.35 to 1.42 | 1.40 to 1.44 |
| F | ○ | Δ |
| G | ○ | Δ |

As can be shown from the table mentioned above, in the case in which the control of the toner layer was carried out by pressing to contact the circular portion, the thin toner layer was able to be obtained by a light load. Therefore, the force required for driving the developing roller, namely, the rotation torque does not necessarily have to be large, thereby, the miniaturization and simplification of the driving system can be achieved. Further, when it was used for a long period of time, the compression permanent strain of the developing roller 4a was not caused, and the white lines in the image did not appear. The circular portion of the coating blade is required to have a radius of about 0.2 through 10 mm, preferably about 0.5 through 5 mm, and a mirable type silicone rubber TSE260—7U and TSE270—7U (both are trade name, manufactured by Toshiba Silicone Co., Ltd.), which has excellent abrasion resistance.

Next, a concrete example for the image forming method will be described. One component toner containing styrene acrylic resin as a base, and carbon black, a charging control agent and a flow property reforming agent was used for forming an image to the developing device as structured and mentioned above. The characteristics inquiry was carried out under the conditions as described below. Namely, the toner charged amount was 15 μC/g, the toner adhesion amount on the surface of developing roller 4a was 0.6 mg/cm$^2$, an average particle size of the toner was 8 to 9 μm, the particle size dispersion was 1 to 20 μm, the hardness of the developing roller was 30 degrees (JIS A type), the resistance of the developing roller was $1\times10^4\Omega\cdot cm^2$, the development nip width was 2.0 mm, the periphery speed of the developing roller was 74 mm/sec (2.0 times of the sensitive body), the protection resistance was 10 MΩ, the development bias voltage was −200 V, the image electric potential of the electrostatic latent image was −150 V, the non-imaged part electric potential was −500 V, and a corona charge system was used as the transfer device and its transfer efficiency was 60 to 90%.

First, with regard to the image density of the development, when (Vd/Vp)·m was not less than 0.5 mg/cm$^2$, the obtained image density was not less than 1.2, and when it was less than 0.5, the obtained image density was lower than 1.2 which results in a poor image.

In this example, the toner adhesion amount m/(mg/cm$^2$) on the surface of the developing roller 4a and the linear velocity ratio Vd/Vp between the developing roller 4a and the sensitive drum 1 was used as a parameter, then, the image density obtained by developing on varying Vd/Vp within the range of 0.5 to 3.0 in each case wherein the toner adhesion amount m is 0.2 mg/cm$^2$, 0.5 mg/cm$^2$, 0.8 mg/cm$^2$. As a result, it was confirmed that the image density is not determined only by m or (Vd/Vp), it is substantially determined univocal by a product of m and (Vd/Vp). Therefore, for obtaining the satisfactory development, it is required to set (Vd/Vp)·m in not less than 0.5 mg/cm$^2$.

With regard to the cleaning characteristics, when the above mentioned (Vd/Vp)·m exceeds 3.0, the cleaning function is deteriorated to the point where ghost images appear. Namely, the cleaning characteristics are effected as follows:

(1) the amount of the toner supplied to the unit area on the surface of the sensitive drum equals (Vd/Vp)·m. Therefore, when the rate of (Vd/Vp)·m is large, the apparent thickness of the toner layer in the developing position becomes larger to fade down the cleaning electric field, thereby, the cleaning characteristics are lowered.

(2) since the amount of the toner supplied to the sensitive drum 1 is large, the surplus development results and the toner is adhered to the imaging part in more than the necessary amount, and the amount of the remaining toner 8' is inevitably increased. Therefore, a large amount of the remaining toner 8' must be cleaned up, and the cleaning defection is easily caused.

In view of the truth as mentioned above, in the development cleaning process using one component toner, (Vd/Vp)·m is to be selected in the range of 0.5 mg/cm$^2$ to 3.0 mg/cm$^2$, preferably in the range of 0.8 mg/cm$^2$ to 2.0 mg/cm$^2$.

Further, on taking the notice of only the toner adhesion amount m (mg/cm$^2$) on the surface of the developing roller, when $m<0.2$ mg/cm$^2$, the cleaning characteristics can be sufficiently obvious, but it requires high rotation speed of the developing roller 4a to obtain the satisfactory image density, and the abrasion of the developing roller 4aand the tailing of the image result. When $m>1.2$ mg/cm$^2$, the cleaning characteristics are deteriorated to cause a ghost image on the image regardless of the speed of the developing roller.

When the charge of the toner is less than 3.0 (μC/g), the electrostatic attraction force (image force) acting between the toner 8 and the surface of the developing roller 4a is reduced, the toner particles drop out from the surface of the developing roller 4a, and fogging is caused on the non-imaged part. When the toner charge exceeds 30 (μC/g), the above mentioned image force is increased, therefore, the toner amount being transferred to the sensitive drum 1 is decreased and causes the decrease of image density. Further, in view of the cleaning, since the repulsive force for the remaining toner 8' is increased, ghost images are produced. As a result, the charge of the toner is to be preferably set within the range of 3.0 to 30 (μC/g).

When the linear velocity of the developing roller 4a is less than 1.5 times that of the sensitive drum 1, fogging is increased on the background to lower the cleaning characteristics, and the image density becomes insufficient. The reason for the increase of such fogging is not clear, but it can be considered as one of the reasons that if the speed difference to the sensitive drum 1 is small, the frictional electrification of the toner particles at the developing position becomes insufficient. When the above mentioned speed rate exceeds 4 times, the toner splash in the circumference of the developing roller 4a increases to cause the possible tailing and fogging to appear in the image. Therefore, the ratio of the linear velocity between the developing roller 4a and the sensitive drum 1 is preferably selected in the range of 1.5 times to 4.0 times.

In the image forming method as described above, the suppression of fogging and the control of the cleaning are carried out by the electric field between the non-imaged part in the electrostatic latent image and the developing roller 4a. Namely, an image having an excellent quality and the sufficient image density without fogging and ghost images can be obtained by defining $-500\ V \leqq = Vo - Ve \leqq -100\ V$, and $50\ V \leqq Vq - Ve \leqq 300\ V$, wherein each value of non-imaged part, imaged part and effective developing bias is defined as Vo, Vq and Ve (each value is negative). Herein, when $Vo - Ve > -100$ V, the cleaning electric field is not sufficient, therefore, fogging and ghost images result. When it is $-500 > Vo - Ve$, the cleaning field is too large, therefore, the positive electric charge is injected from the developing roller 4a into the toner particles, and the toner is adhered to the non-imaged part to cause the fogging, and this results remarkably under high humidity atmosphere. In the imaged part, when it $50\ V > Vq - Ve$, the developing electric field is not sufficient, and the image density is not sufficient. When $Vq - Ve > 300$ V, the line image becomes thick from surplus development. Therefore, the relation among each value of non-imaged part, imaged part and effective developing bias, namely, Vo, Vq and Ve (each value is negative) is preferably set as $-500 \leqq Vo - Ve \leqq -100$ V (preferably $-400\ V \leqq Vo - Ve \leqq -200$ V), and $50\ V \leqq Vq - Ve \leqq 300$ V (preferably $70\ V \leqq Vq - Ve \leqq 200$ V).

EXAMPLE 2

First, an explanation will be given on the function of the image forming method by controlling the amount of the toner remaining on the latent image phase of the latent image holder (sensitive drum) in the amount of not more than 0.35 mg/cm$^2$ after the developed image formed by the same method as in the Example 1 is transferred to the image supporter.

Figure 6:
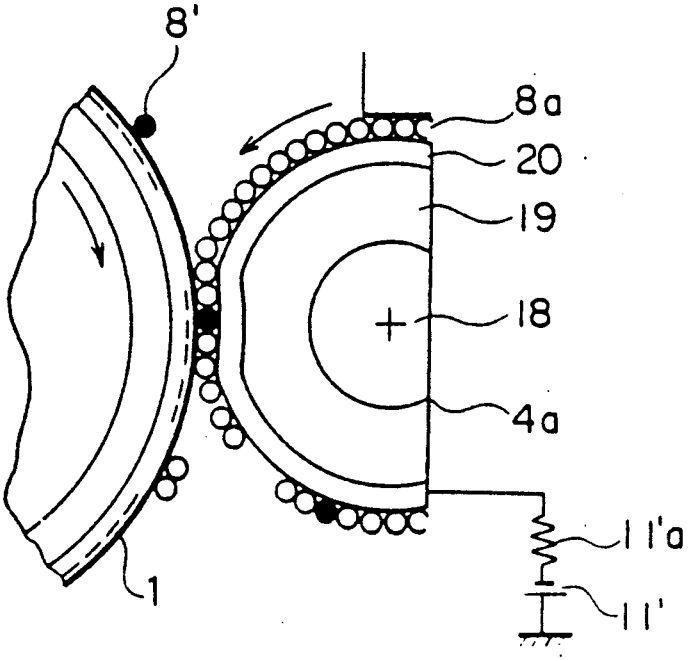
FIG. 6 is a typical view for explaining an image forming mechanism.

FIG. 6 is a cross-sectional view showing a typical image forming mechanism. The case in which the toner layer 8a made of one component non-magnetic toner is formed on the surface of the developing roller 4a provided with the electroconductive shaft 18, the flexible layer 19 and the electroconductive layer 20, then, it is contacted with the surface of the sensitive drum as the latent image holder 1 to obtain the image by developing and cleaning. The sensitive drum 1, can be made of a material of the positive electrification type such as the selenium type and the negative electrification type formed of zinc oxide or organic photoconductive material. Here, it will be explained wherein the latent image is formed by image exposing on the organic sensitizing body of the negative electrification type, and the reverse development is carried out to the obtained latent image by the negative electrification toner 8 and the remaining toner 8' on the sensitive drum 1 is cleaned up simultaneously. The electroconductive surface layer 20 of the developing roller 4a is connected to the developing bias electric power 11, through the protection resistance 11'a, and then applied with the developing bias of the voltage $V_b$.

Figure 7:
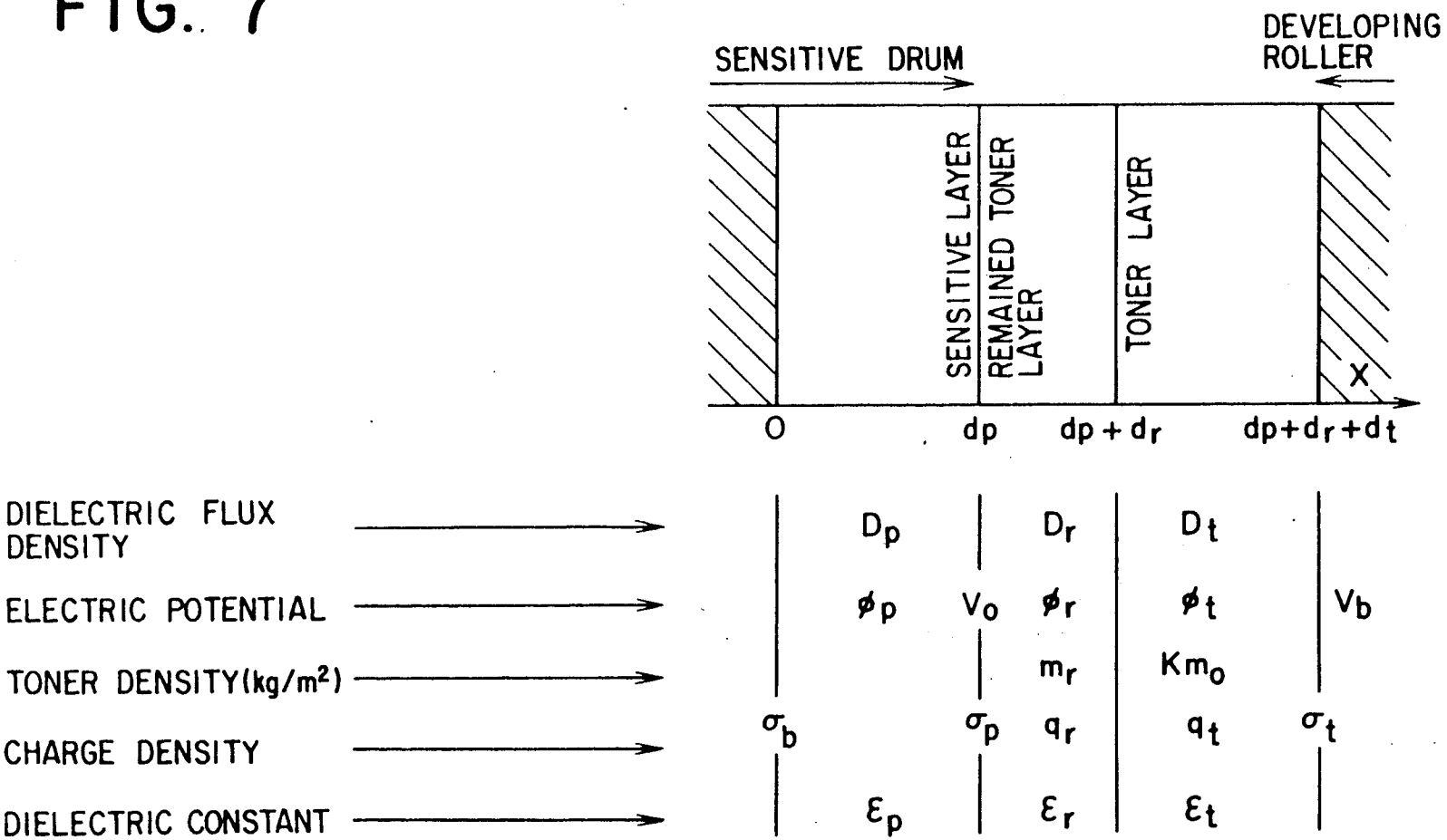
FIG. 7 is a typical view showing a modeled distributing condition of an electric potential of each portion and a toner density in a development area.

The territory analysis will be carried cut by modeling the development area in FIG. 6 as shown in FIG. 7. Gauss' law is applied to each layer of FIG. 7.

$$d\ ivD_p = 0$$

$$d\ ivD_r = \rho_r$$

$$\mathrm{div}\,D_t=\rho_t$$

The boundary conditions are as follows on defining the unit normal line vector in x axis as n:

$$D_p\cdot n=\sigma_b$$

$$(D_r-D_p)\cdot n=\sigma_p$$

$$(D_t-D_r)\cdot n=0$$

$$"D_r n=\sigma_t$$

$$\phi_p(0)=0$$

$$\phi_p(d_p)=\phi_r(d_p)$$

$$\phi_r(d_p+d_r)=\phi_t(d_p+d_r)$$

$$\phi_t(d_p+d_r+d_t)=V_b$$

When the surface electric potential of the sensitive layer before reaching to the development area is defined as $V_0$;

$$\sigma_p=\epsilon_p V_0/d_p$$

And when the toner electric charge is converted from the volume electric charge densities $\rho_r$ and $\rho_t$ into the weight electric charge densities $q_r$ and $q_t$;

$$\sigma_r=q_r/d_r m_r,$$

$$\sigma_t=q_t/d_t k m_0,$$

Herein, the symbols in FIG. 7 are used. The symbol k designates the speed ratio given from $k=V_r/V_p$, when each linear velocity of the developing roller 4*a* and the sensitive drum 1 is defined as $V_r$ and $V_p$. The symbol $m_0$ designates the toner adhesion amount on the surface of the developing roller 4*a*, and its unit is $kg/m^2$.

Figure 8:
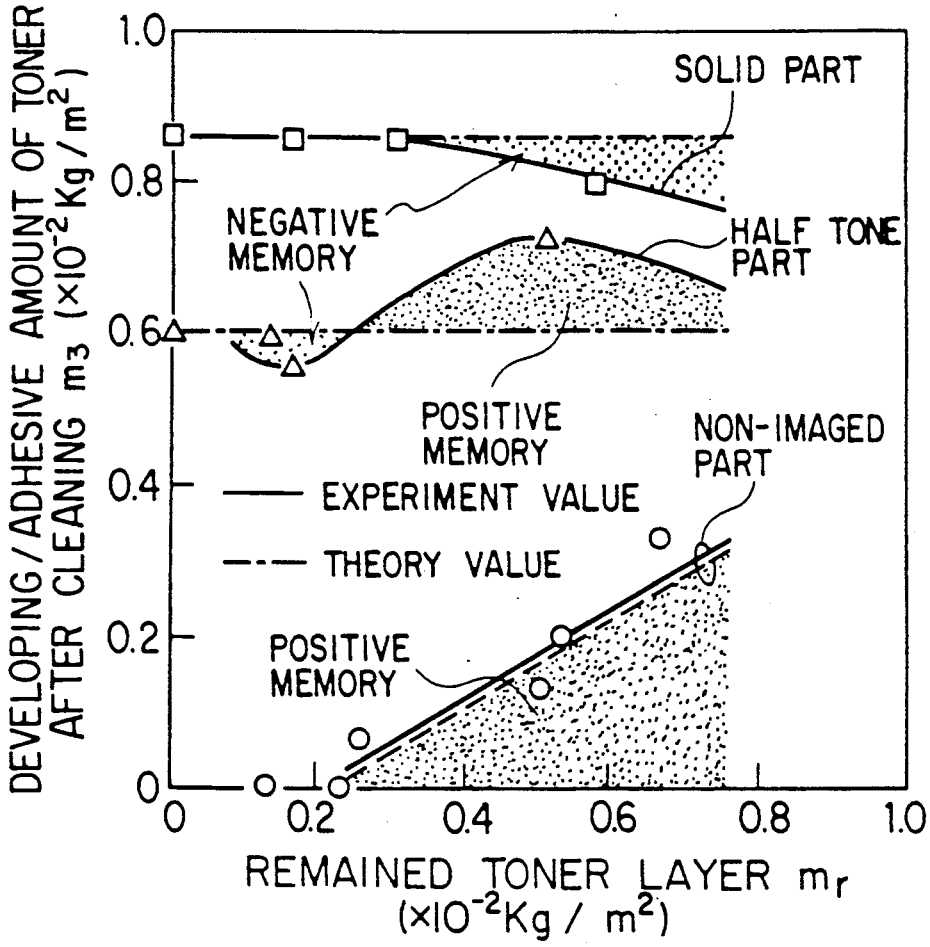
FIG. 8 is a graph showing a relation between an amount of the remaining toner after transferring in the image forming and an amount of the remaining toner on the latent image holder after cleaning is simultaneously carried out with the development.

Upon solving the above mentioned problem on the boundary value, and obtaining the electric field $d\phi_r/dx$, and defining the value of x when it is $d\phi_r/dx=0$ as $x_0$, the remaining toner layer is separated at the position of $x=x_o$ in the last step of development, thereby, it is separated into the sensitive drum 1 side and the developing roller 4*a* side. The amount of the remaining toner m after cleaning can be expressed by the formula as mentioned below on using the result from the above mentioned boundary value problem.

$$\begin{aligned} m &= m_r(x_0-d_p)/d_r \\ &= 1/A\,\{(d_r/2\epsilon_r+d_t/\epsilon_t)m_r- \\ &\quad (V_0-V_b)/q_r+ \\ &\quad 1/2q_t/q_r\cdot d_t/\epsilon_t k m_0\} \end{aligned}$$

wherein, $A=d_p/\epsilon_p+d_r\epsilon_r+d_t/\epsilon_t$. The result obtained by calculating the cleaning characteristics on inserting the experimental value into the above mentioned formula is shown by the dashed lines in FIG. 8. FIG. 8 shows the variation of the toner amount m on the sensitive drum 1 after developing and simultaneous cleaning by the amount $m_r$ of the remaining toner 8' after transfer.

$$V_0-V_b=-200\ V$$

$$d_p=20\ \mu m,\ d_r=11\ \mu m,\ d_t=11\ \mu m$$

$$\epsilon_p=3.4\epsilon_0, \epsilon_r=1.0\epsilon_0$$

$$\epsilon_t=1.0\epsilon_0 (0\text{: dielectric constant in vacuum})$$

$$q_r=-3.1\times10^{-2} C/kg$$

$$q_t=-1.26\times10^{-2} C/kg$$

$$k=2.0$$

wherein, the toner amounts m and $m_r$ on the sensitive drum 1 were obtained by measuring the weight of the sensitive drum after the adhesion of the toner. The toner electrification amount $q_r$ and $q_t$ were calculated by measuring the amount of the electric charge flowing into a Coulomb's meter connected to the electroconductive base of the sensitive drum when the toner on the sensitive drum was blown by air.

The physical meaning shown by the dashed lines is as described below. Since the electric potential condition $V_0-V_b=-200$ V corresponds to the non-imaged part, the remaining toner 8' is to be completely cleaned up under the condition mentioned above. Namely, the region m=0 becomes the proper region in which the memory is not generated. The result from the above theory analysis indicates that the cleaning can be completely carried out if the amount $m_r$ of the remaining toner 8' after the transfer is not more than $0.23\times10^{-2}$ $kg/m^2$. Further, in view of the harmonization with the result from the experiment described in the figure, it is remarkably satisfactory, therefore, it can be considered that the theory analysis as described above is appropriate.

The symbols $q_t$, $m_0$ and k among the above mentioned experimental values, are the parameters which are relatively easily varied by the material of the toner and the setting condition of the image forming device. On varying these parameters within the practically variable range ($q_t=-0.2\times10^{-2}$ through $-2.5$ C/kg, $m_0=2.0\times10^{-3}/8.0\times10^{-3}$ $kg/m^2$, k=1.2 through 3.5), and the theory curve was calculated. As a result, the cleaning can be carried out until $0.35\times10^{-2}$ $kg/m^2$ (=0.35 $mg/cm^2$) at maximum in accordance with the condition. Therefore, a sufficient image without toner remaining after the cleaning to the non-imaged part (namely, without positive memory) can be obtained by setting the remaining toner 8' at not more than 0.35 $mg/cm^2$, preferably not more than 0.23 $mg/cm^2$.

In FIG. 8, the results from the experiment regarding a half tone and a solid image are indicated as well as the characteristics in the above mentioned non-imaged part. The solid image corresponds to the part in which the electric potential of the sensitive drum 1 is sufficiently damped by the image exposure as the latent image.

Therefore, if the amount of the remaining toner 8' is excessively large, the damping of the electric potential tends to be inhibited by the light cutoff action to decrease the developing toner amount (namely, negative memory is generated). It can be known from FIG. 8, the amount of the remaining toner 8' is preferably set at not more than $0.5\times10^{-2}$ kg/m$^2$ for keeping the amount of the developing toner in not less than $0.8\times10^{-2}$ kg/m$^2$.

The half tone image corresponds to the intermediate electric potential condition between the imaged part electric potential and the non-imaged part electric potential, therefore, it has low development electric field or cleaning electric field and the memory is easily generated. However, the latent image formed of the aggregation of the mesh point image and the fine line is also regarded as the half tone image when it is the intermediate electric potential to the macro. In concrete, the half tone image region is defined as the region having an average distance between the images at not more than 0.5 mm. In FIG. 8, among the various half tone images, it is selected the half tone image in which the memory is notably appearing, and the characteristics thereof are shown. It can be known from FIG. 8, that the negative memory or the positive memory appears when the remaining toner 8' exceeds $0.1\times10^{-2}$ kg/m$^2$. Therefore, when the half tone image is included, the generation of the memory can be controlled by setting the amount of the toner 8' at not more than 0.1 mg/cm$^2$, preferably not more than 0.04 mg/cm$^2$.

Figure 9:
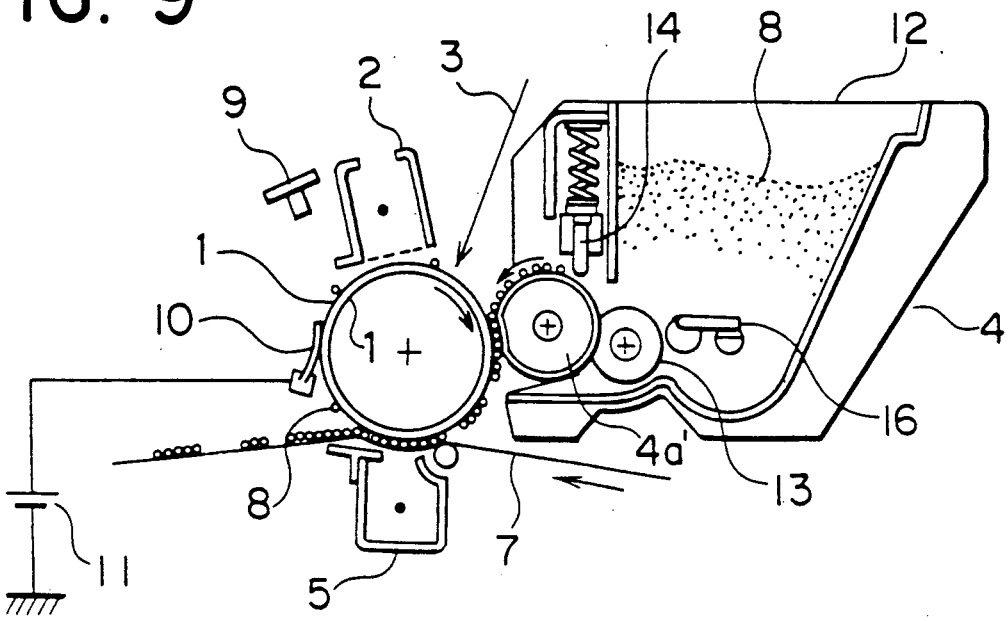
FIG. 9 is a cross-sectional view showing the main portion of another cleanerless image forming device used in the image forming method according to the present invention.

FIG. 9 is a cross-sectional view showing the main structure of the image forming device utilized in the present example. Numeral 1 designates the sensitive drum corresponding to the latent image holder, the organic sensitive body of the negative electric charge is used in this example, and this sensitive drum 1 is negatively charged in the corona electric charge by the electrification device 2. The latent image is formed by the exposure to a light beam, such as a laser beam 3, from an image modulated exposure device. The developing device 4 is used as a system for forming the thin layer of non magnetic toner on the developing roller 4a' by pressing the coating blade 14 on the surface of the developing roller 4a' having electroconductivity and flexibility. Therefore, the developing roller 4a' is pressurized to the sensitive drum 1 on keeping the nip width of 2 through 3 mm, and rotates at the surface speed in the range of 1.2 to 4.0 times of the sensitive drum 1. The developing roller 4a' has a flexible layer 19 having a rubber hardness of 15 to 40 degrees and an electroconductive layer 20 having a resistance of not more than $10^7$ cm provided in order on the periphery of the metal shaft 18' or the dielectric layer having the thickness in the range of 20 to 100 μm provided on the surface of the flexible layer having electroconductivity (not more than $10^{11}$ Ω·cm). At the contacting position between the developing roller 4a' and the sensitive drum 1, the development is carried out simultaneously with the cleaning as described above. The electric potential on the developing roller 4a' is preferably set in the range of −150 through −400 V, the electric potential on the non-imaged part of the sensitive drum 1 is preferably set in the range of −300 through −600 V, and the electric potential of the imaged part is preferably set in the range of 0 to −150 V.

The present invention is not limited only to the examples as described above, for example, the image forming method utilizing the jumping method disclosed in Japanese Patent Publication No. 32375, 1983 and U.S. Pat. No. 4,342,822 etc., and the FEED developing method disclosed in Japanese Patent Publication No. 35984, 1988 and Japanese Patent Application Laid Open No. 176961, 1986 are able to be included in the present invention. Further, the present invention is applicable to all the methods for forming the image by contacting the thin toner layer composed of non-magnetic or magnetic toner in general.

What is claimed is:

1. An image forming method, comprising the steps of:

forming a latent image on a latent image holder, the surface of the latent image holder moving at a linear velocity Vp;

forming a developing agent layer including a one component developing agent on a developing agent holder, the surface of the developing agent holder moving at a linear velocity Vd, wherein the developing agent holder is arranged to contact the latent image holder;

developing the latent image on the latent image holder by contacting the developing agent layer on the developing agent holder;

transferring the developed image onto an image supporter and cleaning a developing agent adhered to a non-image part of the latent image holder after the step of transferring, the cleaning step being simultaneously carried out with the step of the developing, wherein the linear velocity Vd, the linear velocity Vp and an adhering density m of the developing agent layer are set in the range expressed by the following formula:

$$0.5\leqq(Vd/Vp)\cdot m\leqq3.0$$

wherein m is expressed in mg/cm$^2$.

2. The image forming method according to claim 1, wherein the linear velocity Vd, the linear velocity Vp, and the adhering density of the developing agent layer are set in the range expressed by the following formula:

$$0.8\leqq(Vd/Vp)\cdot m\leqq2.0.$$

3. The image forming method according to claim 1, wherein said developing agent adhering density m on the surface of said developing agent holder is set in the range of 0.2 to 1.2 mg/cm$^2$.

4. The image forming method according to claim 1, wherein said developing agent holder is an elastic roller, and the absolute value of electric charge amount of said developing agent layer formed on the surface of said developing agent holder is set in the range of 3 to 30 μC/g, the linear velocity Vd of the surface of said developing agent holder is set in the range of 1.5 to 4.0 times the linear velocity Vp of the surface of said latent image holder, the absolute value of electric potential difference between the surface of said developing agent holder and said non-image part of said latent image holder is set in the range of 100 to 500 V, and the absolute value of electric potential difference between the surface of said developing agent holder and an imaged part of said latent image holder is set in the range of 50 to 300 V.

5. The image forming method according to claim 4, wherein said elastic roller is formed with an elastic layer coaxially provided on the periphery of a metal shaft, and an electric resistance value between the surface of said elastic layer and said metal shaft is not more than $1\times10^7\ \Omega\cdot cm^2$.

6. An image forming method, comprising the steps of:

forming a latent image on a latent image holder;

forming a developing agent layer of a one component developing agent on a developing agent holder, wherein the latent image holder is rotationally kept in contact with the developing agent holder;

developing the latent image on the latent image holder by contacting the developing agent layer on the developing agent holder;

transferring the developed image onto an image supporter and cleaning the developing agent that remains adhered to a latent image of the latent image holder after transferring, the cleaning step being carried out simultaneously with the step of the developing, wherein the amount of the remaining developing agent is set at not more than 0.35 $mg/cm^2$.

7. The image forming method according to claim 6, wherein the amount of said remaining developing agent is set at not more than 0.23 $mg/cm^2$.

8. The image forming method according to claim 7, wherein the amount of said remaining developing agent is set at not more than 0.1 $mg/cm^2$.

9. The image forming method according to claim 6, wherein the surface electric potential of said developing agent holder is set in the range of −150 to −400 V, the electric potential of an non-imaged part of said latent image holder is set in the range of 31 300 to −600 V, and the electric potential of an imaged part of said latent image holder is set in the range of 0 to −150 V.

10. The image forming method according to claim 6, wherein a brush is contacted with said latent image holder after the step of transferring to uniformly disperse said remaining developing agent adhered to said latent image holder.

* * * * *

UNITED STATES PATENT AND TRADEMARK OFFICE

CERTIFICATE OF CORRECTION

PATENT NO. : 5,051,332

DATED : September 24, 1991

INVENTOR(S) : MASAHIRO HOSOYA ET AL

It is certified that error appears in the above-indentified patent and that said Letters Patent is hereby corrected as shown below:

ON THE TITLE PAGE

Abstract, line 6, after "surface" insert --of--.

Abstract, line 11, change "ghe" to --the--.

Claim 1, column 18, line 23, after "supporter" insert --;--.

Claim 1, column 18, line 24, after "supporter" insert --;--.

Claim 1, column 18, line 25, change "non-image" to --non-imaged--.

Claim 4, column 18, line 59, change "non-image" to --non-imaged--.

Claim 6, column 19, line 12, after "supporter" insert --;--.

UNITED STATES PATENT AND TRADEMARK OFFICE

CERTIFICATE OF CORRECTION

PATENT NO. : 5,051,332 Page 2 of 2

DATED : September 24, 1991

INVENTOR(S) : MASAHIRO HOSOYA ET AL

It is certified that error appears in the above-indentified patent and that said Letters Patent is hereby corrected as shown below:

Claim 9, column 20, line 10, change "an" to --a--.
Claim 9, column 20, line 11, change "31 300" to -- -300--.

Signed and Sealed this

Eighth Day of June, 1993

*Attest:*

Michael K. Kirk

MICHAEL K. KIRK

*Attesting Officer*

*Acting Commissioner of Patents and Trademarks*